US005230491A

United States Patent [19]

Tseng

[11] Patent Number: 5,230,491

[45] Date of Patent: Jul. 27, 1993

[54] TABLE LEG ASSEMBLY

[75] Inventor: Chuen-Jong Tseng, Chiayi Hsien, Taiwan

[73] Assignee: Shin Yeh Enterprise Co., Ltd., Taiwan

[21] Appl. No.: 936,132

[22] Filed: Aug. 27, 1992

[51] Int. Cl.[5] ..... F16M 11/20

[52] U.S. Cl. ..... 248/188.1; 248/188; 248/205.1; 403/174; 403/178; 403/217

[58] Field of Search ..... 248/188, 188.1, 205.1, 248/220.2, 200, 231.9; 403/335, 336, 337, 217, 218, 174, 178

[56] References Cited

U.S. PATENT DOCUMENTS 3,632,147 1/1972 Flinger ..... 403/217 X
3,754,728 8/1973 Bowman ..... 248/188
4,163,537 8/1979 Mourgue ..... 248/188.1
4,247,218 1/1981 Jeannin ..... 403/217
4,318,352 3/1982 Friedman et al. ..... 248/188 X
4,357,118 11/1982 Murray ..... 403/218 X

*Primary Examiner*—Ramon O. Ramirez
*Attorney, Agent, or Firm*—Ladas & Parry

[57] ABSTRACT

A table leg assembly includes a plurality of vertical legs, a plurality of radial bars to brace the vertical legs, and a central body to interconnect the radial bars. The body includes a cylindrical rigid block which has a top end and a bottom end, a cylindrical periphery that interconnects the top and bottom ends, and a plurality of ribs that extend vertically and that project radially from the cylindrical periphery at predetermined angular intervals. The table leg assembly further includes a plurality of curved connecting plates, each being disposed between two adjacent ribs and each having two opposite ends screwed to the two adjacent ribs. Each of the connecting plates is integrally connected to a respective one of the radial bars.

3 Claims, 5 Drawing Sheets

TABLE LEG ASSEMBLY

BACKGROUND OF THE INVENTION

1. Field of the Invention

This invention relates to a table leg assembly, more particularly to a table leg assembly which includes a plurality of vertical legs which are braced by a plurality of radial bars.

2. Description of the Related Art

There are different types of tables which are ideal for different purposes, e.g. a dining table, a writing table, a desk bureau, etc.. Durability is an important factor which is considered when one selects a desired table. Since the stability of a table is related to the durability of the same, and since the firmness of the table legs affects the stability of the table, table manufacturers usually install different types of table leg assemblies in order to increase the stability of the table legs, thereby preventing the table from swaying due to external forces.

As shown in FIG. 1, in a known table leg assembly, one end of a radial bar B is connected to a respective table leg A, while the other end of the radial bar B extends toward a central ring-shaped member C and is connected to the periphery of the latter. The radial bar B can be connected to the ring-shaped member C in two ways, as shown in FIGS. 2 and 3.

Referring to FIG. 2, the end of the radial bar B which extends toward the ring-shaped member C has an arc face to abut the periphery of the ring-shaped member C and further has a projecting pin B1 with a length that is shorter than the diameter of the cross-section of the ring-shaped member C.

The ring-shaped member C has a plurality of insert holes C1 to receive the pins B1 of the radial bars B. The inner diameter of the insert hole C1 is slightly greater than the diameter of the pin B1 so as to permit the insertion of the pin B1 into the insert hole C1.

During assembly, adhesive is applied onto the pins B1 of the radial bars B and the insert holes C1 of the ring-shaped member C. The pins B1 of the radial bar B are then inserted into the corresponding insert holes C1 of the ring-shaped member C, thereby connecting the bars B and the ring-shaped member C.

Referring to FIG. 3, one end of the radial bar B extends toward the central ring-shaped member C and has an arc face to abut the periphery of the ring-shaped member C. The arc face is formed with an axial screw bore B1'.

The ring-shaped member C has a plurality of insert holes C1' to receive screw bolts D. During assembly, each bolt D passes through a washer D1 and one of the insert holes C1' so as to engage the screw bore B1' of one of the radial bars B.

The above-described table leg assembly has some disadvantages. As shown in FIGS. 2 and 3, the connecting and supporting area between the radial bar B and the ring-shaped member C is merely at the locations where the pins B1 or bolts D contact the ring-shaped member C and is thus relatively small. Furthermore, variations in weather conditions (such as humidity) and the application of external forces (such as those for moving the table or those exerted by the weight of the user's legs on the bars) may further reduce the connecting strength and loosen the connection of the bar and the ring-shaped member.

SUMMARY OF THE INVENTION

The objective of this invention is to provide an improved table leg assembly with an enhanced durability and stability.

According to this invention, a table leg assembly of this invention includes a plurality of vertical legs and is characterized by:

a plurality of radial bars to brace the vertical legs;

a central body to interconnect the radial bars, said central body including a cylindrical rigid block which has a top end and a bottom end, a cylindrical periphery interconnecting the top and bottom ends, and a plurality of ribs extending vertically and projecting radially from the cylindrical periphery at predetermined angular intervals; and a plurality of curved connecting plates, each being disposed between two adjacent ribs and each having two opposite ends screwed to the two adjacent ribs, each of the connecting plates being integrally connected to one of the bars.

BRIEF DESCRIPTION OF THE DRAWINGS

An embodiment of this invention will be described in detail with reference to the accompanying drawings, in which.

DETAILED DESCRIPTION OF THE PREFERRED EMBODIMENT

Figure 1:
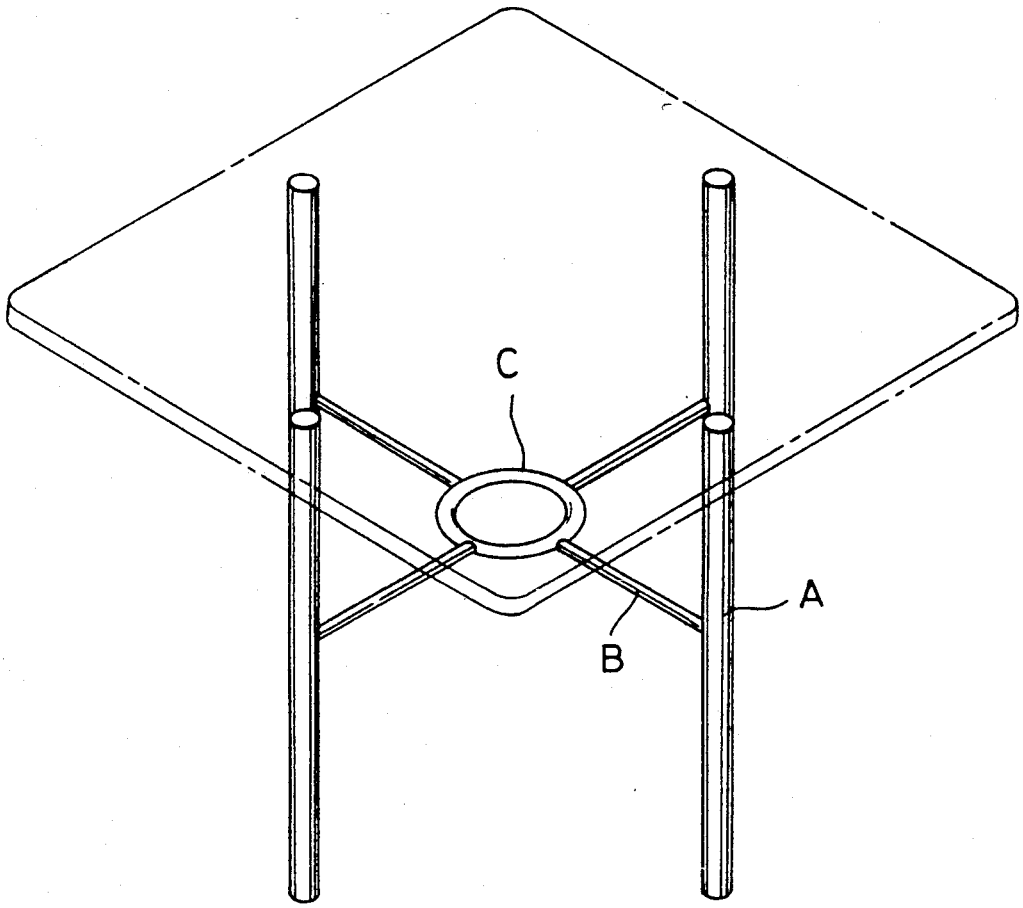
FIG. 1 (PRIOR ART)
FIG. 1 shows a known table leg assembly.
Figure 2:
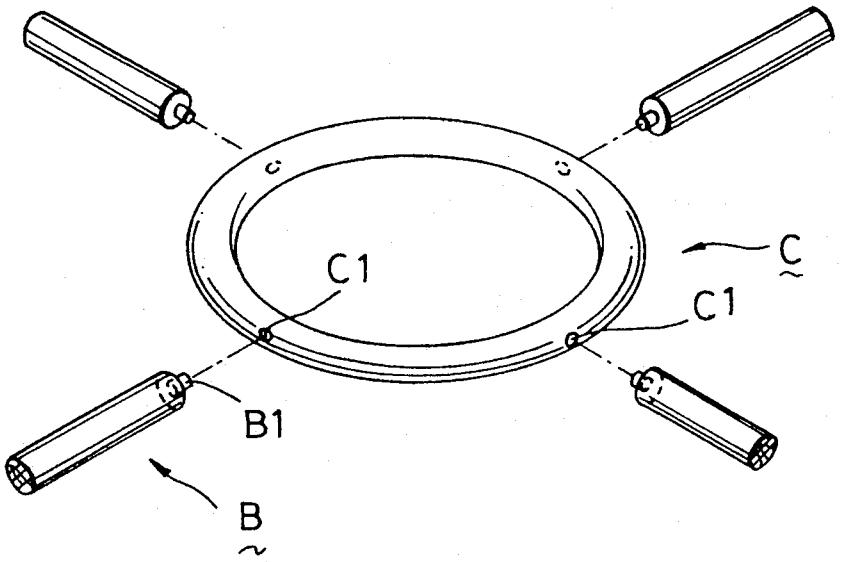
FIG. 2 (PRIOR ART)
FIGS. 2 and 3 shows two methods of assembly for the table leg assembly shown in FIG. 1.
Figure 3:
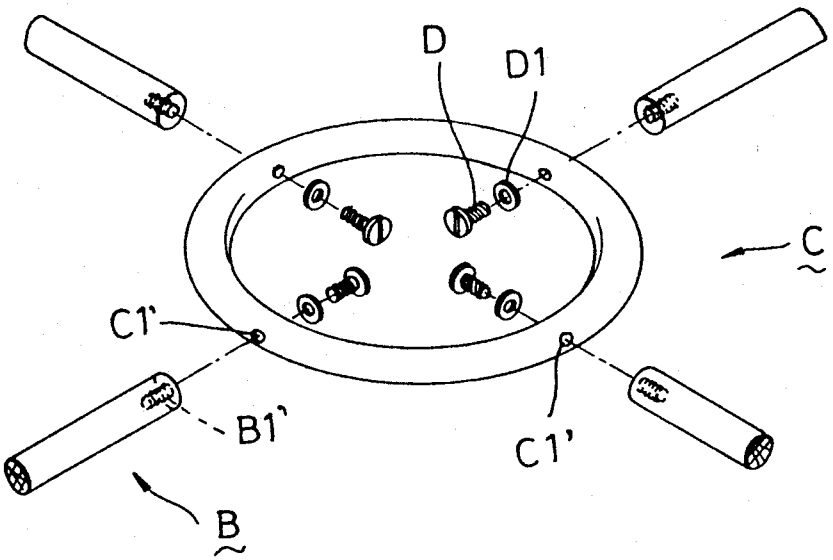
FIG. 3 (PRIOR ART)
Figure 4:
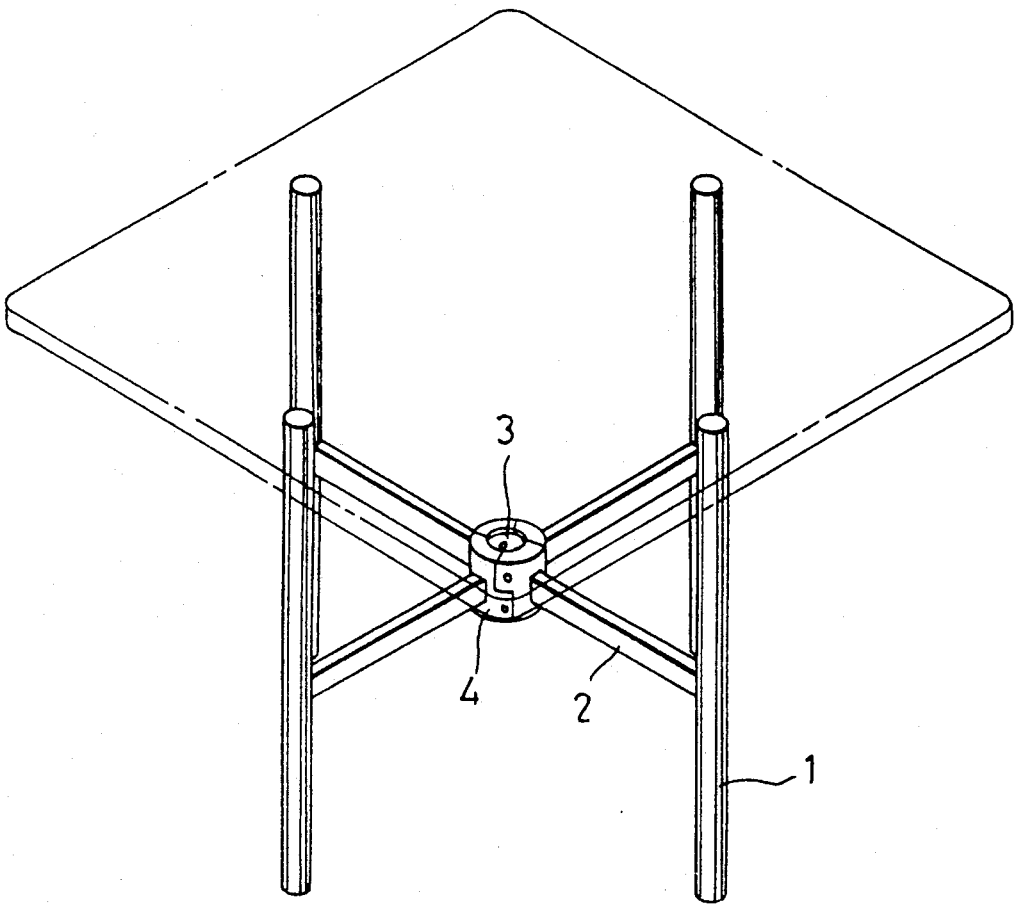
FIG. 4 is a perspective view of the preferred embodiment of a table leg assembly according to this invention.

Referring to FIG. 4, the table leg assembly of this invention can be used to support a table top. Each vertical leg 1 is connected firmly to one end of a respective radial bar 2 by means of screws (not shown). The other end of the radial bars 2 extends toward a central body 3 and is connected integrally to a respective one of curved connecting plates 4 which are assembled around and secured to the central body 3.

Figure 5:
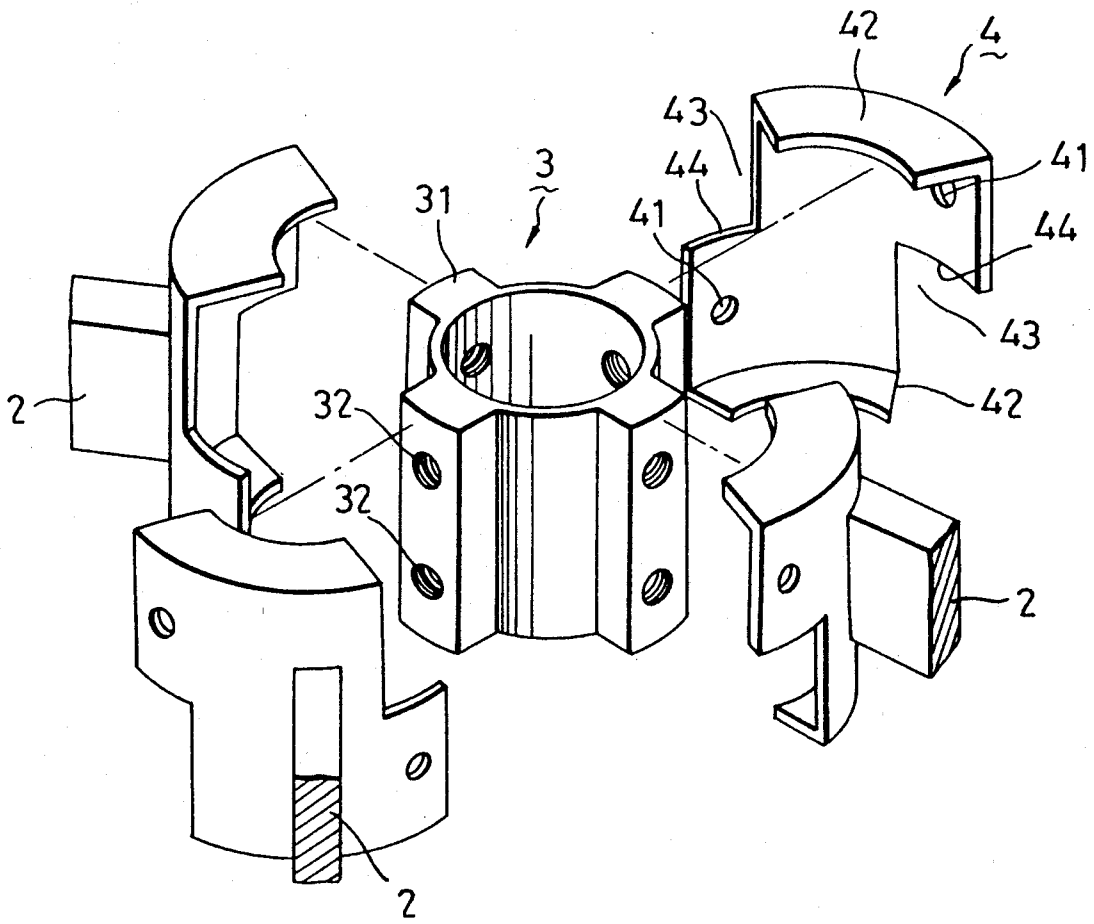
FIG. 5 is an exploded view of the embodiment shown in FIG. 4.

As shown in FIG. 5, the central body 3 may be a compression-molded aluminum product and is in the form of a hollow cylinder. The central body 3 includes a plurality of ribs 31 which extends vertically and projects radially from its periphery at predetermined angular intervals. Each rib 31 includes two screw holes 32 respectively provided at the top and bottom portions thereof.

The connecting plates 4 are compression-molded aluminum plates which are curved so as to surround the periphery of the central body 3. Each plate 4 is integrally molded with one of the bars 2. The two opposite ends of each connecting plate 4 are stepped, and each stepped end of the connecting plates 4 has a projecting part 44, which extends over and which is screwed to a respective one of the ribs 31, and a notched part 43, which receives the projecting part 44 of an adjacent one of the curved connecting plates 4. Each projecting part 44 includes a screw hole 41 to be screwed to one of the screw holes 32 on the corresponding radial rib 31. Each curved connecting plate 4 has top and bottom flanges 42 which extend over and abut against the top and bottom ends of the central body 3, respectively.

After assembling the above components, since the central body 3 and the connecting plates 4 are made of aluminum, the table leg assembly can bear increased loads and can resist deformation and fracture. In addition, the table leg assembly is not easily affected by weather conditions and is not susceptible to rusting.

The table leg assembly of this invention has an increased connecting area at the joints thereof so that it can provide a greater bearing capacity. Furthermore, the radial ribs 31 of the central body 3 have a proper thickness so that they can firmly receive the screws and prevent the screws from loosening. Moreover, the presence of the top and bottom flanges 42 enhances the bearing capacity of the connecting plates 4. Therefore, the entire construction of the table leg assembly of this invention is strong and durable.

While the present invention has been described in connection with what is considered the most practical and preferred embodiment, it is understood that this invention is not limited to the disclosed embodiment but is intended to cover various arrangement included within the spirit and scope of the broadest interpretation so as to encompass all such modifications and equivalent arrangements.

I claim:

1. A table leg assembly, comprising:

a plurality of vertical legs;

a plurality of radial bars to brace said vertical legs;

a central body interconnecting said radial bars, said body including a cylindrical rigid block having a top end and a bottom end, a cylindrical periphery interconnecting said top and bottom ends, and a plurality of ribs vertically extending and radially projecting from said cylindrical periphery at predetermined angular intervals; and a plurality of curved connecting plates, each being disposed between two adjacent said ribs and each having two opposite ends screwed to said two adjacent said ribs, each of said connecting plates being integrally connected to one of said radial bars.

2. A table leg assembly as claimed in claim 1, wherein each of said connecting plates has a top flange and a bottom flange extending over and abutting against a respective one of said top and bottom ends of said central body.

3. A table leg assembly as claimed in claim 2, wherein said two opposite ends of each said connecting plate are stepped, each of said stepped ends having a notched part and a projecting part screwed to each of said ribs, said notched part of each of said connecting plates receiving said projecting part of an adjacent one of said connecting plates.

* * * * *